US006561214B2

(12) United States Patent
Heil

(10) Patent No.: US 6,561,214 B2
(45) Date of Patent: May 13, 2003

(54) HYDRANT WITH IMPROVED DRAIN MECHANISM

(76) Inventor: Howard Heil, 1761 Oxnard Dr., Downers Grove, IL (US) 60516

( * ) Notice: Subject to any disclaimer, the term of this patent is extended or adjusted under 35 U.S.C. 154(b) by 0 days.

(21) Appl. No.: 09/829,719

(22) Filed: Apr. 10, 2001

(65) Prior Publication Data

US 2002/0144731 A1 Oct. 10, 2002

(51) Int. Cl.[7] ..... E03B 9/14
(52) U.S. Cl. ..... 137/307; 137/302; 137/550
(58) Field of Search ..... 137/272, 283, 137/302, 307, 308, 549, 550; 239/542, 553, 566; 405/36, 43, 44, 45, 47, 50

(56) References Cited

U.S. PATENT DOCUMENTS

| | | | | | |
|---|---|---|---|---|---|
| 683,945 | A | | 10/1901 | Kennedy | 137/302 |
| 795,964 | A | | 8/1905 | Ellis | 137/302 |
| 1,172,959 | A | * | 2/1916 | Dormon | 137/307 |
| 1,340,352 | A | * | 5/1920 | Whitmore | 137/283 |
| 1,349,062 | A | * | 8/1920 | Goldberg | 137/283 |
| 2,109,187 | A | * | 2/1938 | Vogel | 137/307 |
| 2,664,096 | A | | 12/1953 | Murdock et al. | 137/218 |
| 3,017,896 | A | | 1/1962 | Papacek | 137/282 |
| 3,070,116 | A | * | 12/1962 | Noland et al. | 137/302 |
| 3,429,125 | A | * | 2/1969 | Shotton | 239/542 |
| 3,534,762 | A | * | 10/1970 | Noland | 137/307 |
| 3,552,654 | A | * | 1/1971 | Thomas | 239/542 |
| 3,698,195 | A | * | 10/1972 | Chapin | 239/542 |
| 3,777,987 | A | * | 12/1973 | Allport | 239/542 |
| 3,834,539 | A | | 9/1974 | Thompson | 210/167 |
| 3,858,599 | A | * | 1/1975 | Carlson | 137/307 |
| 3,901,448 | A | * | 8/1975 | Babin | 239/542 |
| 3,946,762 | A | * | 3/1976 | Green | 239/542 |
| 3,980,096 | A | * | 9/1976 | Ellis et al. | 137/307 |
| 3,980,097 | A | | 9/1976 | Ellis | 137/283 |
| 4,061,272 | A | * | 12/1977 | Winston | 239/542 |
| 4,094,466 | A | * | 6/1978 | DeRomano | 239/542 |
| 4,224,701 | A | | 9/1980 | Huang | 4/206 |
| 4,372,339 | A | | 2/1983 | Anderson | 137/288 |
| 4,483,361 | A | | 11/1984 | Jungbert, Sr. | 137/301 |
| 4,653,521 | A | | 3/1987 | Fillman | 137/1 |
| 4,854,339 | A | | 8/1989 | Hoeptner, III | 137/282 |
| 4,948,295 | A | * | 8/1990 | Pramsoler | 239/566 |
| 5,033,500 | A | | 7/1991 | Hoeptner, III | 137/282 |
| 5,078,862 | A | | 1/1992 | Justice | 210/94 |
| 5,701,925 | A | | 12/1997 | Mulligan et al. | 137/119.05 |
| 6,056,211 | A | | 5/2000 | DiLoreto | 239/288 |

OTHER PUBLICATIONS

Wahlstrom, et al., "The Design and Manufacture of Fire Hydrants," Design Project #1: Casting Manufacturing Methods Spring 2000 (Mar. 3, 2000).

"Types of Dry Barrel Hydrants" taken from AWWA Manual M17 www.firehydrant.org/info/drybarreltypes.html printed Jun. 29, 2000, 6 pages.

(List continued on next page.)

*Primary Examiner*—George L. Walton
(74) *Attorney, Agent, or Firm*—McAndrews, Held & Malloy, Ltd.

(57) ABSTRACT

A fire hydrant of the "dry" barrel type having an improved means of draining the barrel after the hydrant has been used. The hydrant is provided with a drain passageway communicating the interior of the hydrant barrel to the exterior. A diffuser is attached to the hydrant at the drain passageway and receives water therefrom. The diffuser eliminates the need for force flushing the drain passageway and the localized draining of the hydrant barrel, thus eliminating soil erosion in the vicinity of the hydrant. Furthermore, the diffuser protects the interior components of the hydrant from entrance of foreign matter.

25 Claims, 3 Drawing Sheets

OTHER PUBLICATIONS

"Definitions and Names of Hydrant Components," taken from AWWA Manual M17 www.firehydrant.org/info/nomenclature.html printed Jun. 29, 2000, 2 pages.
"The Dry Hydrant Concept," Step 3 www.firewise.org/pubs/operationWater/dry hyd concept.html printed Jun. 29, 2000, 2 pages.
"Installing Dry Hydrants," www.firewise,org/pubs/operationWater/installing dry hyd.html printed Jun. 29, 2000, 3 pages.
"Dry Hydrant Design Features Checklist," www.firewise.org/pubs/operationWater/dry hyd checklist.html printed Jun. 29, 2000, 2 pages.

* cited by examiner

HYDRANT WITH IMPROVED DRAIN MECHANISM

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention generally relates to hydrants, but more specifically to the draining of fire hydrants after use. The most common type of fire hydrant manufactured today is the "dry" barrel fire hydrant. The dry barrel hydrant gets its name from the fact that water is pumped or drained from the hydrant barrel when the hydrant is not in use to prevent corrosion of the interior and freezing of the hydrant in winter weather. Water flow into and out of the hydrant barrel is controlled through the manipulation of a main valve located in the base of the hydrant. When the main valve is opened, the barrel is pressurized and available for use. When the main valve is closed, water enclosed within the barrel is drained.

Since the main valve of the dry barrel hydrant is located underground, below the freeze line, the hydrant incorporates an automatic means for draining the barrel above the main valve after each use. The means for draining the hydrant barrel is usually an automatic drain valve working in conjunction with the operation of the main hydrant valve. The drain valve is automatically open, allowing water to drain from the interior of the barrel to the exterior of the hydrant, when the main hydrant valve is closed, and closed when the main hydrant valve is open. This process will maintain the hydrant barrel dry at all times during non-use and prevent corrosion or freezing of the hydrant.

Drain valves for fire hydrants may be of the slide valve type, spring loaded valve type, sliding tube type, or cam operated to open and/or closed type. The most predominantly used type of drain valve is the slide valve type. In this type of drain valve, the valve consists of a drain passageway and a drain valve facing strip. The drain passageway extends from the interior of the barrel, at a location just above the main valve, through the barrel or base of the hydrant to the exterior of the hydrant. The drain valve facing strip is located on a longitudinal rib extending upward from the main valve. The rib and drain valve facing strip are positioned such that the facing strip is either covering or not covering the opening of the drain passageway depending upon the position of the main valve.

In dry barrel hydrants, the drain valves operate automatically such that the drain passageway is either open, providing for drainage, or closed. Therefore, the passageway remains open whenever the main hydrant valve is closed. Consequently, when a hydrant is located in an area where water may collect for any period of time above the hydrant main valve, and thus the drain passageway, there is the opportunity for water or water with dirt, grit, and other foreign matter to backflow through the drain passageway into the hydrant. Backflow can cause damage to the hydrant's main valve or corrosion to the interior parts of the hydrant. There is also a danger of subsequent freezing if the backflow pressure is sufficient to raise the water level in the barrel above the freezing line.

To prevent backflow of water through the drain passageway some hydrants have incorporated backflow preventer valves. However, these devices are prone to mechanical failure, corrosion, and clogging by foreign matter. Failure of the backflow preventer exposes the hydrant to the backflow of ground water and may result in the release of high pressure water during hydrant use, resulting in water and water pressure loss and in destruction erosion of the soil surrounding the hydrant.

Clogging of the drain passageway is also an issue in wet areas where backflow of water and/or water with dirt, grit, and other foreign matter is likely. Clogging of the drain passageway prevents drainage of the barrel after use of the hydrant and can lead to corrosion of the interior of the hydrant and/or freezing of the water trapped in the hydrant barrel. In an attempt to prevent clogging of the drain passageway many hydrant drain valves are constructed of a force-flushing design. By this design, the drain valve remains open momentarily as the main hydrant valve begins to open and/or just before the main hydrant valve closes so that full main pressure is applied to the drain passageway to clear foreign material from the drain valve and passageway before the hydrants next use. However, this flushing is not guaranteed to remove all foreign matter and often results in destructive erosion of the soil surrounding the hydrant.

After use of the dry barrel hydrant, all water is automatically drained from the barrel into the immediate vicinity surrounding the hydrant. The flow of the water draining from the hydrant may result in general or localized erosion of the soil in the area surrounding the hydrant. Flushing and failure of backflow preventers results in destructive erosion of the soil surrounding the hydrant. Since the vast majority of hydrants are located in cities along sidewalk and roadways, the effect of this erosion over time results in undermining and eventual failure of these surfaces.

BRIEF SUMMARY OF THE INVENTION

Broadly stated the present invention relates to an improvement in a hydrant and, more particularly, to the addition of an improved drainage arrangement for allowing drainage of a dry barrel hydrants over a larger drainage field, thus, preventing erosive effects to the soil surrounding the hydrant, and for the prevention of the backflow of foreign matter into the hydrant. This drainage arrangement includes a diffusion means connected to the exterior of the hydrant at the outer end of the drain passageway(s).

DETAILED DESCRIPTION OF THE PREFERRED EMBODIMENT

While the invention is claimed in connection with one or more preferred embodiments, it will be understood that the invention is not limited to those embodiments. On the contrary, the invention includes all alternatives, modifications, and equivalents as may be included within the spirit and scope of the appended claims.

Figure 1:
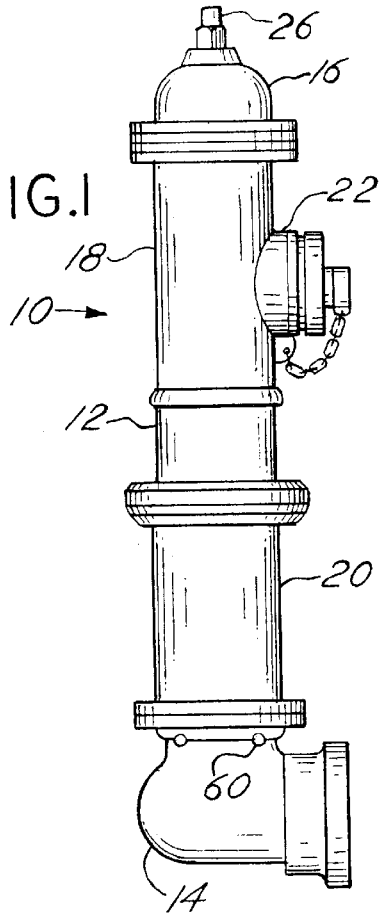
FIG. 1 is a side elevational view of a fire hydrant embodiment.

Referring now to FIG. 1, a fire hydrant generally designated at 10 and having a barrel 12, a base 14, a bonnet section 16. The barrel 12 is usually made in two sections, an upper section 18 and a lower section 20. One or more nozzle outlets 22 are provided on the upper barrel section 18 to which a hose may be connected. The main hydrant valve is operated by an operating nut 26 projecting outwardly of the bonnet 16 and operatively connected to the reciprocating valve stem of the hydrant to be described later.

Figure 2:
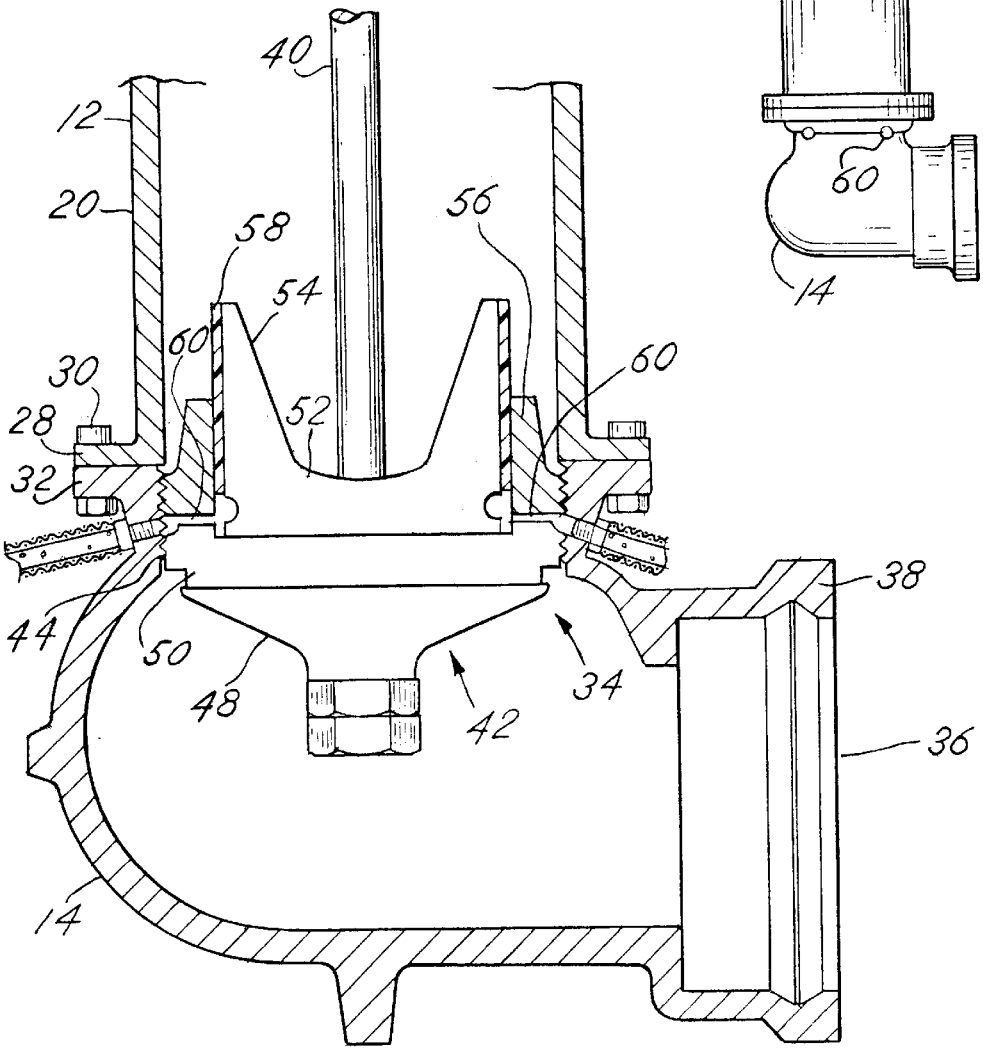
FIG. 2 is an enlarged fragmentary vertical sectional view of the lower portion of the fire hydrant of FIG. 1.

Referring now to FIG. 2, the lower section 20 of the barrel 12 is provided with a flanged end 28 arranged to be bolted by bolts 30 to the flanged end 32 surrounding an upwardly opening mouth 34 of the hydrant base 14. The hydrant base 14 herein depicted is referred to as a hydrant shoe. The hydrant base 14 is provided with an inlet end 36 having a flange 38 surrounding the same for attachment to a water pressure supply.

As shown in FIG. 2 a valve stem 40 extends downwardly through the barrel 12 and is connected at its upper end to the operating nut 26 so that rotation of the nut 26 causes the valve stem 40 to move vertically up or down. Attached to the lower end of the valve stem 40 is the main hydrant valve member generally designated at 42, the main hydrant valve member being arranged to cooperate with the main hydrant valve seat 44. The main hydrant valve member 42 includes a lower valve plate 48, a rubber or rubber-like valve element 50, and an upper valve plate 52. The upper valve plate 52 includes one or more longitudinally and upwardly extending ribs 54. In this example, the valve plate 52 includes two ribs 54. The ribs 54 ride in longitudinal grooves provided in the valve seat ring 56. Attached to the ribs 54 is the drain valve facing 58. The drain valve facing 58 is made of rubber or a plastic material such as polyethylene.

A drain passageway 60 extends through the base 14 and the hydrant seat ring 56. The drain passageway 60 opens at one end to the exterior of the hydrant 10 and at the other end to the interior of the barrel 12 above the main hydrant valve seat 44. There may be one or more of these drain passageways 60. In the hydrant shown in FIG. 2 there are two. The drain valve facing 58 attached to the main hydrant valve member 42 is positioned in such a manner as to control water flow through the drain passage 60, thus providing a drain valve means that closes the passageway 60 when the main valve member 42 is open and opens the passageway 60 when the main hydrant valve 42 is closed.

Figure 3:
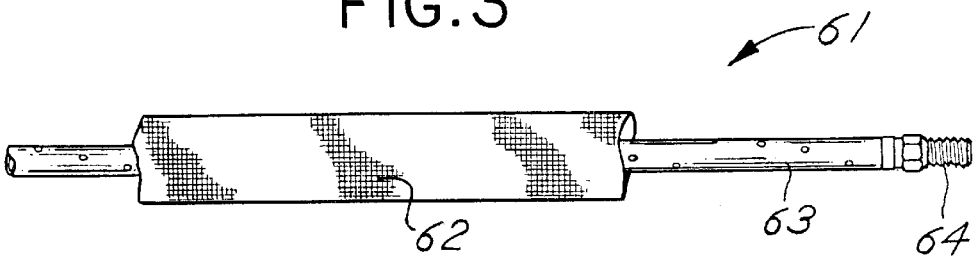
FIG. 3 is a perspective view of an external diffuser for use with the fire hydrant of FIG. 1.

Referring now to FIG. 3, the diffuser 61 includes a mesh screen 62, a perforated tube 63, and a diffuser connection 64. The mesh screen 62 completely encloses the perforated tube 63 and is mechanically sealed to the tube near or at the diffuser connection. The perforated tube 63 is mechanically attached to the diffuser connection 64. The diffuser connection 64 is selected such that it can be attached to one of the hydrant's drain passageways 60.

In operation, water drains from the hydrant barrel 12 through the drain passageways 60, through the diffuser connection 64, into the perforated tube 63, out the perforations in the perforated tube 63, into the mesh screen 62, and then out the perforations in the mesh screen 62 into the drainage field surrounding the fire hydrant 10. To form a tight and leak free connection between the diffuser 61 and the drain passageways 60, the diffuser connection 64 may either be smooth and of a size which will fit tightly into the passageway 60 or be threaded to form a tight connection with the threaded interior walls of the drain passageway 60. In a preferred embodiment, the perforated tube 63 is constructed of ½-inch PVC tubing incorporating ⅜-inch holes ½ to 1½ inches apart. Also in the preferred embodiment, the mesh screen is made of a vinyl coated polyester with a mesh size between 1 and 60 mm. In this embodiment a material with a low rate of diffusion and small aperture size would be desired to prevent soil erosion and entry of sand, grit, or foreign material into the hydrant during conditions conducive to backflow. The length of the diffuser varies depending on the requirements for a particular hydrant. For example, diffuser 61 is cylindrical in shape and approximately three feet in length.

Although FIG. 2 illustrates the preferred embodiment of the diffuser 61, several alternate embodiments may also be used. For example, instead of using the vinyl coated polyester, the mesh screen 62 may be constructed of another material such as a plastic, fiberglass, or canvas. The mesh screen 62 may also be replaced by either perforated hose or a permeable material such as foamed vinyl plastic, namely, polyvinyl chloride (PVC), or a foamed rubber material. The selection of the mesh screen material is based on the desired rate of diffusivity and aperture size. Also, in the alternative, the perforated tube 63 may be constructed of another material such as a plastic or metal. Also, the size and number of the perforations in the perforated tube 63 may altered to increase or decrease the rate of drainage.

Figure 4:
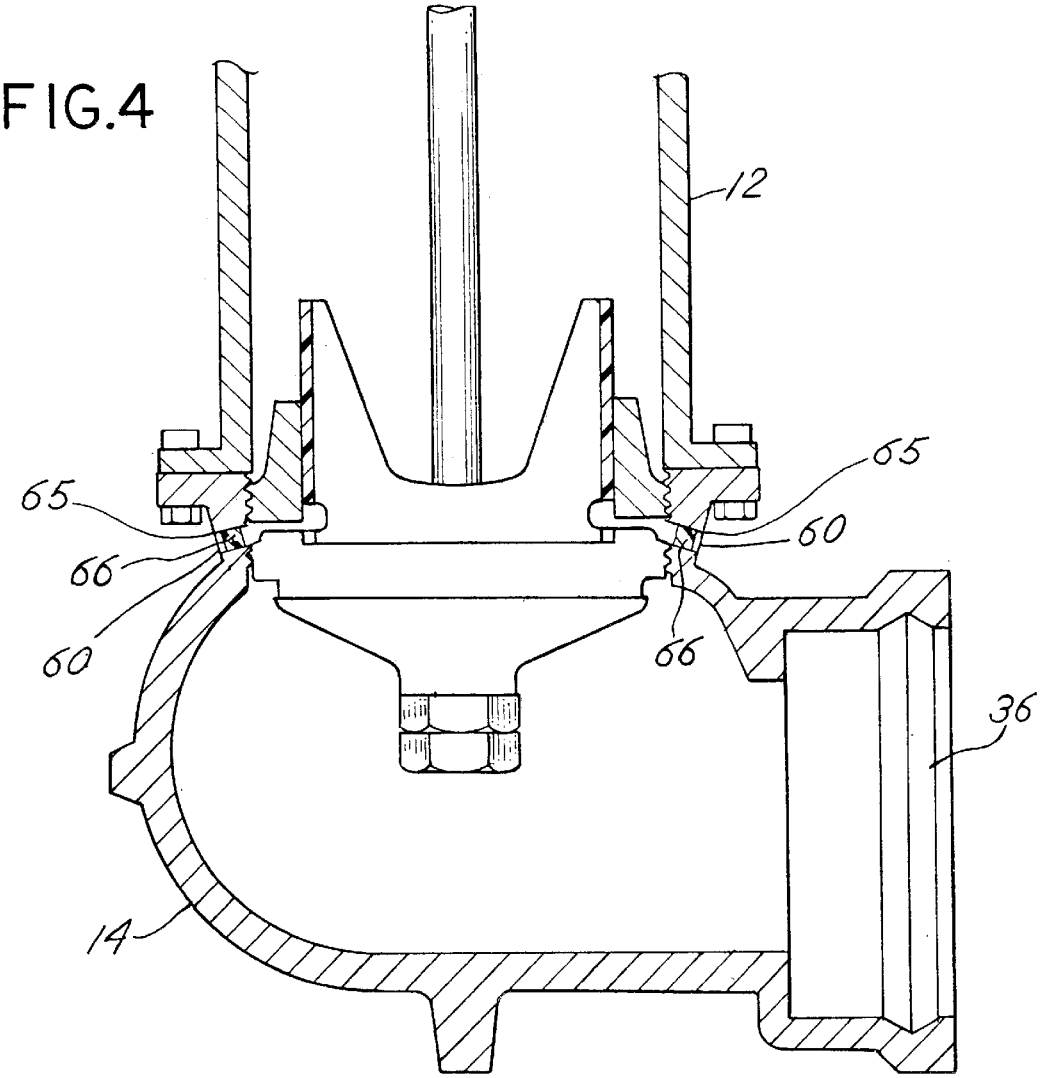
FIG. 4 is an enlarged fragmentary vertical sectional view of the lower portion of the fire hydrant of FIG. 1 incorporating a permeable insert within the drain passageway.

Referring now to FIG. 4, the drain passageway 60 is filled with a permeable insert 66. The insert 66 may be formed externally and put into the drain passageway or formed directly within the passageway. In a preferred embodiment, the insert 66 is formed of a permeable material such as foamed vinyl plastic, such as polyvinyl chloride (PVC), or a foamed rubber and secured within the drain passageway 60 with an adhesive 65. The insert material is selected based on the desired rate of diffusivity and aperture size. In this embodiment a material with a low rate of diffusion and small aperture size would be desired to minimize soil erosion and prevent entry of sand, grit, or foreign material into the hydrant during conditions conducive to backflow.

Figure 5:
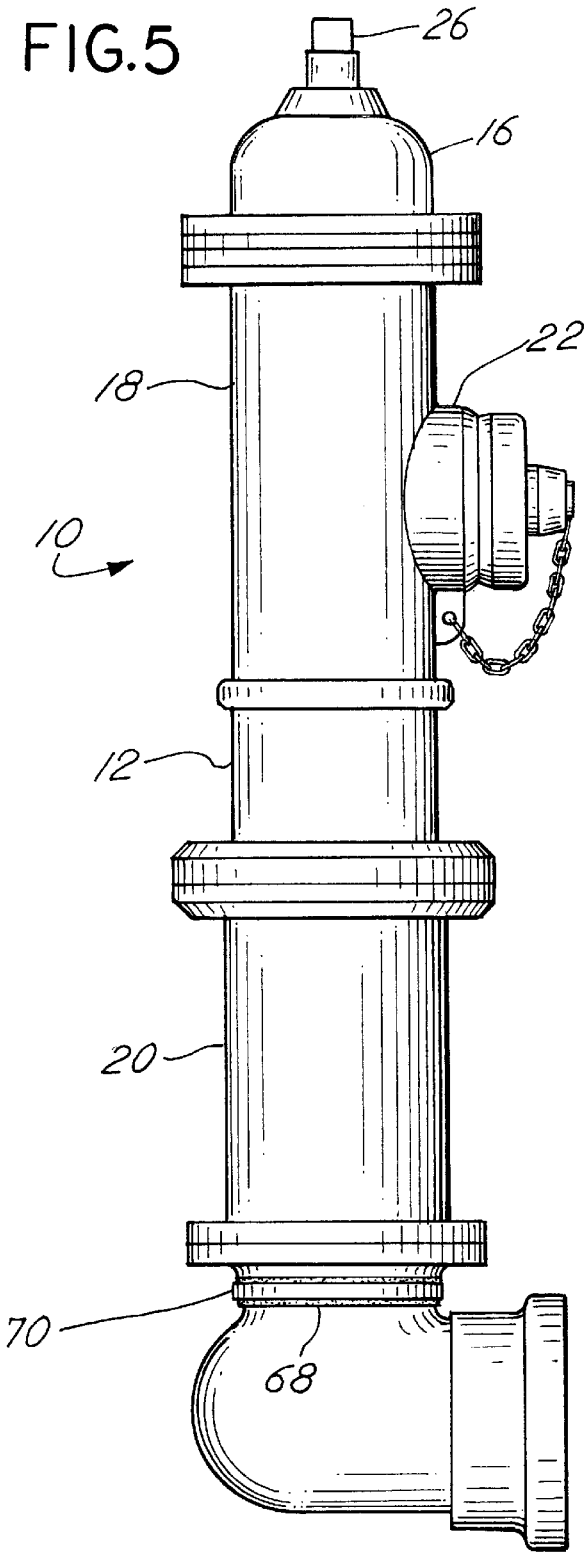
FIG. 5 a perspective view of an external diffusing wrap in use on the fire hydrant of FIG. 1.

Referring now to FIG. 5, a wrap 68 is attached around the exterior of the hydrant 10 effectively covering the drain passageways. In a preferred embodiment, the wrap 68 is formed of a permeable material such as foamed vinyl plastic, such as polyvinyl chloride (PVC), or a foamed rubber and secured around the hydrant with metal or plastic straps 70. The wrap material is selected based on the desired rate of diffusivity and aperture size. In this embodiment a material with a low rate of diffusion and small aperture size would be desired to minimize soil erosion and prevent entry of sand, grit, or foreign material into the hydrant during conditions conducive to backflow.

While particular elements, embodiments and applications of the present invention have been shown and described, it is understood that the invention is not limited thereto since modifications may be made by those skilled in the art, particularly in light of the foregoing teaching. It is therefore contemplated by the appended claims to cover such modifications and incorporate those features which come within the spirit and scope of the invention.

What is claimed is:

1. A fire hydrant comprising:

a hydrant barrel having:

(1) a nozzle for releasing water pressure; and (2) a lower flanged opening arranged to be connected to a source of water pressure;

a main valve disposed within said hydrant barrel and operable to control water entering said hydrant barrel;

a drain passageway communicating the interior of the hydrant barrel with the exterior; and a water diffuser, disposed relative to said drain passageway and receiving water therefrom, said water diffuser includes a permeable tube extending outwardly from said hydrant barrel and having a permeable structure disposed for transferring water laterally of said tube without said hydrant barrel.

2. A fire hydrant of claim 1 and further including a second valve for opening and closing said drain passageway.

3. A fire hydrant of claim 2 wherein said second valve is operably connected to said main valve for opening said drain passageway in accordance with the position of said main valve.

4. A fire hydrant of claim 1 wherein said diffuser includes a mesh screen.

5. A fire hydrant according to claim 4 wherein said mesh screen surrounds said tube.

6. A fire hydrant of claim 1 wherein said permeable tube is constructed from a rigid material.

7. A fire hydrant of claim 1 wherein said permeable tube is a perforated hose.

8. A fire hydrant of claim 1 wherein said diffuser includes a mechanical connecting means connecting said diffuser to said drain passageway.

9. A fire hydrant of claim 8 wherein the interior walls of said drain passageway include mechanical threads.

10. A fire hydrant of claim 9 wherein said mechanical connecting means is threaded at one end for threading tightly within said drain passageway.

11. A fire hydrant of claim 8 in which said permeable tube is constructed from a non-rigid material.

12. A fire hydrant according to claim 1 wherein said permeable tube is approximately three feet in length.

13. A fire hydrant according to claim 1 wherein said permeable structure includes aperture defining wall portions of said permeable tube.

14. A fire hydrant according to claim 1 wherein said permeable structure includes a mesh screen.

15. A fire hydrant comprising:

a hydrant barrel having:

(1) a nozzle for releasing water pressure; and (2) a lower flanged opening arranged to be connected to a source of water pressure;

a main valve disposed within said hydrant barrel and operable to control water entering said hydrant barrel;

a drain passageway communicating the interior of said hydrant barrel with the exterior for draining water from said hydrant barrel;

an insert water diffuser, disposed within said drain passageway, said insert water diffuser is formed to include a permeable material and disposed within said drain passageway to reduce the rate of water flow through said drain passageway.

16. A fire hydrant of claim 15 and further including a second valve for opening and closing said drain passageway.

17. A fire hydrant of claim 16 wherein said second valve is operably connected to said main valve for opening said drain passageway in accordance with the position of said main valve.

18. A fire hydrant of claim 15 wherein said insert diffuser is mechanically attached to said drain passageway by an adhesive.

19. A fire hydrant comprising:

a hydrant barrel having:

(1) a nozzle for releasing water pressure; and (2) a lower flanged opening arranged to be connected to a source of water pressure;

a main valve disposed within said hydrant barrel and operable to control water entering said hydrant barrel;

a drain passageway communicating the interior of the hydrant barrel with the exterior; and a water diffuser disposed against the exterior of said hydrant barrel and covering said drain passageway, said water diffuser formed to include a permeable material and disposed across said drain passageway to reduce the rate of water flow through said drain passageway.

20. A fire hydrant of claim 19 and further including a second valve for opening and closing said drain passageway.

21. A fire hydrant of claim 20 wherein said second valve is operably connected to said main valve for opening said drain passageway in accordance with the position of said main valve.

22. A fire hydrant of claim 19 wherein said water diffuser is wrapped around said hydrant barrel.

23. A fire hydrant of claim 22 and further including a mechanical fastener securing said water diffuser around said hydrant barrel.

24. A fire hydrant of claim 23 wherein said mechanical fastener includes a strap.

25. A fire hydrant of claim 24 wherein said strap is constructed of plastic.

* * * * *